US007205726B2

(12) United States Patent
Maeda et al.

(10) Patent No.: US 7,205,726 B2
(45) Date of Patent: Apr. 17, 2007

(54) DISCHARGE LAMP DRIVE APPARATUS AND LIQUID CRYSTAL DISPLAY APPARATUS

(75) Inventors: Hiroshi Maeda, Tokyo (JP); Satoshi Shinbo, Tokyo (JP); Masahiro Gamou, Tokyo (JP); Satoshi Sugimoto, Tokyo (JP); Nobuo Kitajima, Tokyo (JP); Terumasa Toyoda, Tokyo (JP)

(73) Assignee: TDK Corporation, Tokyo (JP)

( * ) Notice: Subject to any disclaimer, the term of this patent is extended or adjusted under 35 U.S.C. 154(b) by 7 days.

(21) Appl. No.: 11/258,899

(22) Filed: Oct. 27, 2005

(65) Prior Publication Data

US 2006/0103329 A1 May 18, 2006

(30) Foreign Application Priority Data

Nov. 15, 2004 (JP) ..... 2004-331157

(51) Int. Cl.
*H05B 41/24* (2006.01)

(52) U.S. Cl. ..... 315/277; 315/291; 315/307

(58) Field of Classification Search ..... 315/209 R, 315/210, 213, 255, 274–287, 291, 297, 307, 315/308, 312; 363/17, 21.13, 95
See application file for complete search history.

(56) References Cited

U.S. PATENT DOCUMENTS 5,434,480 A * 7/1995 Bobel ..... 315/224
6,362,575 B1 * 3/2002 Chang et al. ..... 315/224
6,548,964 B2 * 4/2003 Kamata et al. ..... 315/209 R
2006/0087262 A1 * 4/2006 Kim et al. ..... 315/312

FOREIGN PATENT DOCUMENTS

JP 51-50455 12/1976

(Continued)

OTHER PUBLICATIONS

U.S. Appl. No. 11/203,958, filed Aug. 16. 2005, Li et al.

(Continued)

*Primary Examiner*—Jimmy Vu
(74) *Attorney, Agent, or Firm*—Oblon, Spivak, McClelland, Maier & Neustadt, P.C.

(57) ABSTRACT

There are provided a discharge lamp drive apparatus which can detect that both ends of at least one of a plurality of discharge lamps is in an open state in a differential drive scheme, and a liquid crystal display apparatus. A first current detection circuit 31 detects a current flowing through a first discharge lamp connection terminal group P1 or a current flowing through a second discharge lamp connection terminal group P3, and generates a first current detection signal S1. A second current detection circuit 32 detects a current flowing through the second discharge lamp connection terminal group P2 or a current flowing through a fourth discharge lamp connection terminal group P4, and generates a second current detection signal S2. A signal processor 30 receives the first current detection signal S1 and the second current detection signal S2, and generates a signal S01 which is used to detect an open state of a discharge lamp based on intensities of both the current detection signals S1 and S2.

11 Claims, 8 Drawing Sheets

FOREIGN PATENT DOCUMENTS

| | | |
|---|---|---|
| JP | 52-32240 | 8/1977 |
| JP | 2-114495 | 4/1990 |
| JP | 6-267674 | 9/1994 |
| JP | 11-3792 | 1/1999 |
| JP | 2004-241136 | 8/2004 |

OTHER PUBLICATIONS

U.S. Appl. No. 11/258,899, filed Oct. 27, 2005, Maeda et al.
U.S. Appl. No. 11/258,908, filed Oct. 27, 2005, Maeda et al.
U.S. Appl. No. 11/345,487, filed Feb. 2, 2006, Shinbo et al.

* cited by examiner

DISCHARGE LAMP DRIVE APPARATUS AND LIQUID CRYSTAL DISPLAY APPARATUS

BACKGROUND OF THE INVENTION

1. Technical Field of the Invention

The present invention relates to a discharge lamp drive apparatus which drives discharge lamps used as a backlight for a liquid crystal, and a liquid crystal display apparatus.

2. Description of the Related Art

In recent years, with an increase in size of a screen of a liquid crystal panel, a circuit scheme which drives a plurality of discharge lamps for a backlight in parallel has been used in one liquid crystal panel. As means for driving the plurality of discharge lamps in parallel, there are a scheme which connects one end side of the plurality of discharge lamps with an inverter circuit and a transformer and connects the other end side of the same with a GND (which will be referred to as a normal drive scheme hereinafter) and a scheme which connects one end side of the plurality of discharge lamps with a first transformer and connects the other end side of the same with a second transformer so that both the transformers are driven in common by using one inverter circuit and the discharge lamps are driven from both sides (which will be referred to as a differential drive scheme hereinafter).

Of these two schemes, according to the differential drive scheme, since an output voltage of the inverter circuit can be reduced and a circuit component having a small withstand voltage can be used, thereby decreasing a cost.

Meanwhile, in a discharge lamp drive apparatus, there occurs a state in which a current does not flow between a transformer and discharge lamps (which will be referred to as an open state hereinafter) in some cases because of, e.g., a contact failure of a discharge lamp electrode with respect to a connector. In such an abnormal state, since a normal liquid crystal display operation cannot be obtained, this state must be detected. As such means, for example, Patent Reference 1 discloses a normal drive type discharge lamp drive apparatus which is provided with a light-off detection circuit which detects the open state.

The discharge lamp drive apparatus disclosed in Patent Reference 1 adopts the normal drive scheme, and the other end side of discharge lamps connected with the GND has a low voltage. Therefore, a resistance is provided between the other end side of the respective discharge lamps and the GND, and a current flowing through the resistance is detected, thereby detecting whether each discharge lamp is in the open state.

However, in case of a discharge lamp drive apparatus adopting the differential drive scheme, since transformers are connected with both ends of the discharge lamps and both the ends of the discharge lamps have a high voltage, it is impossible to take such a circuit configuration as disclosed in Patent Reference 1 in which the resistance is provided between the discharge lamps and the GND.

Further, since the discharge lamp drive apparatus of Patent Reference 1 has a configuration which detects whether each of the plurality of discharge lamps is in the open state, the number of components is increased, and hence a cost cannot be reduced.

Patent Reference 1: Japanese Patent Application Laid-open No. 267674-1994

SUMMARY OF THE INVENTION

It is an object of the present invention to provide a discharge lamp drive apparatus which can detect whether both ends of at least one of a plurality of discharge lamps are in an open state in a differential drive scheme, and a liquid crystal display apparatus.

It is another object of the present invention to provide a discharge lamp drive apparatus which can attain a reduction in cost, and a liquid crystal display apparatus.

To achieve these and other objects, a discharge lamp drive apparatus according to the present invention comprises: an inverter circuit; first and second transformers; a current detection circuit; and a signal processor. The inverter circuit converts a direct-current voltage into an alternating voltage and outputs the converted voltage. The first transformer receives the alternating voltage from the inverter circuit at an input winding thereof, and supplies a first alternating voltage to a first discharge lamp connection terminal group from an output winding thereof. The first discharge lamp connection terminal group includes a plurality of discharge lamp connection terminals so that a plurality of discharge lamps can be connected thereto.

The second transformer receives the alternating voltage from the inverter circuit at an input winding thereof, and supplies a second alternating voltage to a second discharge lamp connection terminal group from an output winding thereof. The second discharge lamp connection terminal group includes a plurality of terminals corresponding to the first discharge lamp connection terminal group so that a plurality of discharge lamps can be connected thereto.

The current detection circuit detects a current flowing through at least one discharge lamp connection terminal in the first discharge lamp connection terminal group and a sum total of currents flowing through the other terminals included in the first discharge lamp connection terminal group.

The signal processor receives a current detection signal from the current detection circuit, and generates a signal which is used to detect an open state of a discharge lamp from the current detection signal.

In the discharge lamp drive apparatus according to the present invention, the plurality of discharge lamps are combined with a liquid crystal plate to constitute a liquid crystal display apparatus. The plurality of discharge lamps are respectively aligned and arranged, and one electrode is connected with the discharge lamp connection terminals in the first discharge lamp connection terminal group. The other electrode is connected with the connection terminals in the second discharge lamp connection terminal group. The liquid crystal plate is arranged on a front side of the discharge lamps.

In the above-described liquid crystal display apparatus, when all the discharge lamps are normally connected with the discharge lamp connection terminals, the respective discharge lamps are driven in parallel from both sides thereof to be normally turned on by the first alternating voltage supplied to one of the electrodes from the output winding of the first transformer and the second alternating voltage supplied to the other electrode from the output winding of the second transformer. Since the liquid crystal plate is arranged on the front side of the discharge lamps, the discharge lamps function as a backlight for the liquid crystal plate.

On the contrary, for example, when at least one of the discharge lamps connected between the first discharge lamp connection terminal group and the second discharge lamp connection terminals enters the both side open state, there occurs a difference between the current flowing through at least one discharge lamp connection terminal in the first discharge lamp connection terminal group and a sum total of currents flowing through the other terminals included in the first discharge lamp connection terminal group as compared with the case where the open state is not provided.

Thus, in the present invention, both the currents are detected by the current detection circuit, a current detection signal is supplied to the signal processor, and a signal which detects the open state of the discharge lamp is generated in the signal processor.

As a concrete conformation, in the discharge lamp drive apparatus according to the present invention, the current detection circuit can include a first current detection circuit and a second current detection circuit. The first current detection circuit detects a current flowing through at least one discharge lamp connection terminal in the first discharge lamp connection terminal group and thereby generates a first current detection signal. The second current detection circuit detects a sum total of currents flowing through the other terminals included in the first discharge lamp connection terminal group and thereby generates a second current detection signal. The signal processor receives the first current detection signal and the second current detection signal, and generates a signal which is used to detect then open state of a discharge lamp based on intensities of both the current detection signals.

As another concrete conformation of the discharge lamp drive apparatus, it is possible to adopt a configuration in which the first current detection circuit detects a current flowing through at least one discharge lamp connection terminal in the second discharge lamp connection terminal group to thereby generate a first current detection signal, the second current detection circuit detects a sum total of currents flowing through the other terminals included in the second discharge lamp connection terminal group to thereby generate a second current detection signal, and the signal processor generates a signal which is used to detect the open state of a discharge lamp based on intensities of the first current detection signal and the second current detection signal. In these cases, above-described function and effect can be demonstrated As still another conformation of the discharge lamp drive apparatus, it is possible to adopt a configuration in which the current detection circuit detects a current flowing through at least one discharge lamp connection terminal selected from the first discharge lamp connection terminal group to thereby generate a first current detection signal, the second current detection circuit detects a current flowing through the output winding of the first transformer to thereby generate a second current detection signal, and the signal processor generates a signal which is used to detect the open state of a discharge lamp based on intensities of the first current detection signal and the second current detection signal.

Alternatively, it is possible to adopt a configuration in which the first current detection circuit detects a current flowing through at least one discharge lamp connection terminal selected from the second discharge lamp connection terminal group to thereby generate a first current detection signal, the second current detection circuit detects a current flowing through the output winding of the second transformer to thereby generate a second current detection signal, and the signal processor generates a signal which is used to detect the open state of a discharge lamp based on intensities of the first current detection signal and the second current detection signal.

In these cases, the same function and effect can be demonstrated when the present invention is applied to a liquid crystal display apparatus.

A generated signal which is used to detect an open state of a discharge lamp can be used in many ways. For example, there can be considered utilization that a signal which detects an open state of a discharge lamp is used to restrict an operation of the inverter circuit or just used for display of an open state.

Further, the liquid crystal display apparatus according to the present invention is not configured to detect whether each of the plurality of discharge lamps is in an open state, resulting in a reduction in cost.

As described above, according to the present invention, the following effects can be obtained.

(a) It is possible to provide a discharge lamp drive apparatus which can detect that both ends of at least one of a plurality of discharge lamps are in an open state in a differential drive scheme, and a liquid crystal display apparatus.

(b) It is possible to provide a discharge lamp drive apparatus which can achieve a reduction in cost and a liquid crystal display apparatus.

The present invention will be more fully understood from the detailed description given here in below and the accompanying drawings which are given by way of illustration only, and thus are not to be considered as limiting the present invention.

DETAILED DESCRIPTION OF THE PREFERRED EMBODIMENTS

Figure 1:
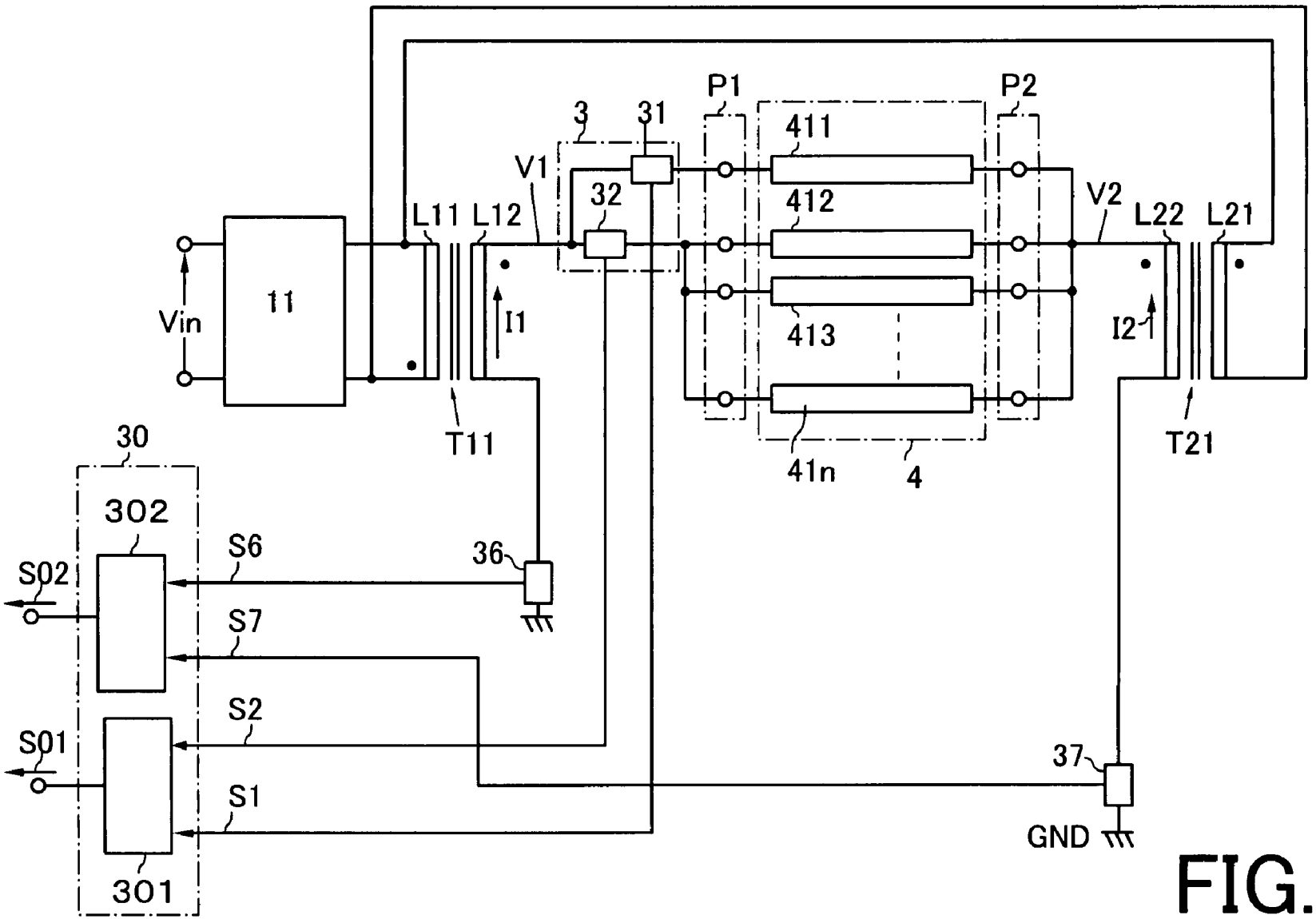
FIG. 1 is an electric circuit diagram showing an embodiment of a discharge lamp lighting apparatus in which a discharge lamp drive apparatus according to the present invention is incorporated.

Referring to FIG. 1, a discharge lamp lighting apparatus in which a discharge lamp drive apparatus according to the present invention is used for a backlight device in, e.g., a liquid crystal TV, a monitor or the like.

The illustrated discharge lamp lighting apparatus adopts a differential drive scheme (a floating scheme), and includes an inverter circuit 11, first and second transformers T11 and T21, a current detection circuit 3, a signal processor 30 and a discharge lamp group 4. Furthermore, in the embodiment, output current detection circuits 36 and 37 are also included. A circuit section excluding the discharge lamp group 4 from the discharge lamp lighting apparatus corresponds to a discharge lamp drive apparatus according to the present invention, and this is a target of business as a device different from the discharge lamp group 4.

The inverter circuit 11 converts a direct-current power Vin into an alternating voltage and outputs the converted voltage. It is preferable for the inverter circuit 11 to output a constant current from the first and second transformers T11 and T21 (constant current control). The direct-current power Vin is generally obtained by converting a commercial alternating current into direct-current electricity and then further converting this electricity by using a DC/DC converter.

In the first transformer T11, a high-voltage side output end of an output winding L12 is led to a first discharge lamp connection terminal group P1 and a second discharge lamp connection terminal group P2. The first transformer T11 receives an alternating voltage from the inverter circuit 11 at an input winding L11 thereof, and outputs a first alternating voltage V1 from the output winding L12 thereof. The first alternating voltage V1 is an alternating high voltage which is, e.g., approximately 800 V.

A low-voltage side output end of the output winding L12 is connected with a ground GND through the output current detection circuit 36. The output current detection circuit 36 generates a current detection signal S6. Although not shown, a current detected by using the output current detection circuit 36 can be also supplied to, e.g., the inverter circuit 11. As a result, it is possible to perform feedback control in such a manner that a current flowing through the ground GND from the low-voltage side output end of the output winding L12 becomes constant.

The first discharge lamp connection terminal group P1 includes n discharge lamp connection terminals, and n discharge lamps 411 to 41*n* can be connected to these terminals in total.

In the second transformer T21, a high-voltage side output end of an output winding L22 is led to the second discharge lamp connection terminal group P2. The second transformer T21 receives an alternating voltage from the inverter circuit 11 at an input winding L21 thereof, and outputs a second alternating voltage V2 from the output winding L22 thereof. The second alternating voltage V2 is also an alternating high voltage which is, e.g., approximately 800 V.

The second discharge lamp connection terminal group P2 includes n individual discharge lamp connection terminals, and n discharge lamps 411 to 41*n* can be connected to these terminals in total.

The second alternating voltage V2 has a phase difference of, e.g., 180 degrees with respect to the first alternating voltage V1. According to such a differential drive scheme, an output voltage of the inverter circuit can be reduced and circuit components having a small withdraw voltage can be used, thereby reducing a cost.

A low-voltage side output end of the output winding L22 is connected with a ground GND through the output current detection circuit 37. The output current detection circuit 37 generates an output current detection signal S7.

The discharge lamp group 4 includes the n discharge lamps 411 to 41*n*. The respective discharge lamps 411 to 41*n* are aligned and arranged in such a manner that their longitudinal directions match with each other. Of the discharge lamps 411 to 41*n*, the discharge lamp 411 has one electrode connected with the first discharge lamp connection terminal group P1 and the other electrode connected with the second discharge lamp connection terminal group P3. Each of the discharge lamps 412 to 41*n* has one electrode connected with the second discharge lamp connection terminal group P2 and the other electrode connected with a fourth discharge lamp connection terminal P4. Since the discharge lamps 411 to 41*n* are of an EEFL type, a ballast circuit is not required, but the ballast circuit must be provided when the discharge lamps are of a CCFL type.

The current detection circuit 3 detects a current flowing through at least one discharge lamp connection terminal in the first discharge lamp connection terminal group P1, and a sum total of currents flowing through the other terminals included in the first discharge lamp connection terminal group P1. In the embodiment, the current detection circuit 3 includes a first current detection circuit 31 and a second current detection circuit 32. Each of the first and second current detection circuits 31 and 32 can be constituted of, e.g., a current transformer, a photo coupler or the like.

The first current detection circuit 31 detects a current flowing through a discharge lamp connection terminal to which the discharge lamp 411 is connected in the discharge lamp connection terminals included in the first discharge lamp connection terminal group P1, and generates a first current detection signal S1. The second current detection circuit 32 detects a sum total of currents flowing through the other discharge lamp connection terminals to which the discharge lamp 411 is not connected, i.e., the discharge lamp connection terminals to which the discharge lamps 412 to 41*n* are connected in the discharge lamp connection terminals included in the first discharge lamp connection terminal group P1, and generates a second current detection signal S2.

In general terms, of the n discharge lamps 411 to 41*n*, assuming that the number of discharge lamps of which the second current detection circuit 32 has charge is m and a total current I, a current Id1 as a detection target of the first current detection circuit 31 and a current Id2 as a detection target of the second current detection circuit 32 are represented as follows:

$$Id1=I\cdot(n-m)/n$$

$$Id2=I\cdot m/n$$

The first current detection circuit 31 detects the current Id1, and generates the first current detection signal S1. The second current detection circuit 32 detects the current Id2, and generates a second current detection signal S2. Since the first current detection signal S1 and the second current detection signal S2 are in proportion to the currents Id1 and Id2, these signals can be expressed as follows:

$$S1=(n-m)/n$$

$$S2=m/n$$

The signal processor 30 generates a signal S01 which is used to detect an open state of a discharge lamp based on an intensity of the second current detection signal S2 supplied from the first current detection circuit 31 and the second current detection circuit 32 constituting the current detection circuit 3 in the first processing portion 301. A signal processing logic in the signal processor 30 for generating the signal S01 may be based on subtraction addition, or ratio. In this embodiment, a description will be given on an example where a ratio is taken.

When all the discharge lamps 411 to 41*n* are normally connected, a ratio of the first current detection signal S1 and the second current detection signal S2 can be obtained as follows based on the above-described general terms:

$$S1/S2=(n-m)/m$$

The first processing portion 301 outputs a signal S01 corresponding to the above-described signal ratio (S1/S2). The signal S01 can be used in many ways. For example, there can be considered a case where a signal which detects an open state of a discharge lamp is used to restrict an operation of the inverter circuit 11 or a case where the signal is used for display of an open state only.

In the embodiment, the signal processor 30 further includes a second processing portion 302 which processes output current detection signals S6 and S7. The second processing portion 302 detects a one-side open state of a discharge lamp based on the signals S6 and S7 supplied from the output current detection circuits 36 and 37, and outputs a detection signal indicative of this state. Furthermore, it supplies an OR signal of the signals S6 and S7 to the inverter circuit 11 and performs feedback control so that an output current becomes constant.

Figure 2:
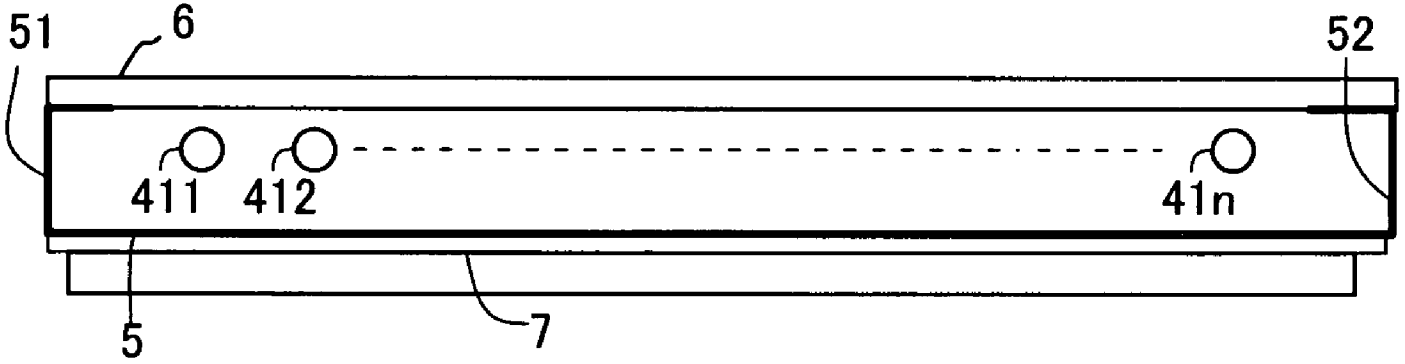
FIG. 2 is a partial cross-sectional view showing a liquid crystal display apparatus in which the discharge lamp lighting apparatus depicted in FIG. 1 is incorporated.

The discharge lamp lighting apparatus shown in FIG. 1 is combined with a liquid crystal plate to constitute a liquid crystal display apparatus. FIG. 2 is a partial cross-sectional view showing a liquid crystal display apparatus in which the discharge lamp lighting apparatus depicted in FIG. 1 is incorporated. The illustrated liquid crystal display apparatus has a configuration in which the discharge lamps 411 to 41*n* are arranged at intervals on a front side of a rear plate 5 and a liquid crystal plate 6 is arranged on a front side of the discharge lamps 411 to 41*n*. The liquid crystal plate 6 is attached at raised portion 51 and 52 which are raised around the rear plate 5. A substrate 7 on which the discharge lamp lighting apparatus having the circuit configuration shown in FIG. 1 is mounted is attached on the other surface of the rear plate 5.

An operation of the liquid crystal display apparatus shown in FIGS. 1 and 2 will now be described. When all the discharge lamps 411 to 41*n* are normally connected (not in an open state), in the discharge lamps 411 to 41*n*, the first alternating voltage V1 is applied to one electrode whilst the second alternating voltage V2 is applied to the other electrode, and a first output current I1 and a second output current I2 thereby flow through the discharge lamp group 4, thus turning on the discharge lamps 411 to 41*n*. Since the liquid crystal plate 6 is arranged on the front surface of the discharge lamp group 4, the discharge lamp group 4 functions as a backlight for the liquid crystal plate 6.

At this time, assuming that m=n−1, a signal ratio (S1/S2) of the first current detection signal S1 output from the first current detection circuit 31 and the second current detection signal S2 output from the second current detection circuit 32 can be expressed as follows:

$$(S1/S2)=1/(n-1).$$

Moreover, the inverter circuit 11 performs a constant current control operation based on the signal S02 fed back from the signal processor 30, thereby maintaining the output currents I1 and I2 constant.

Figure 3:
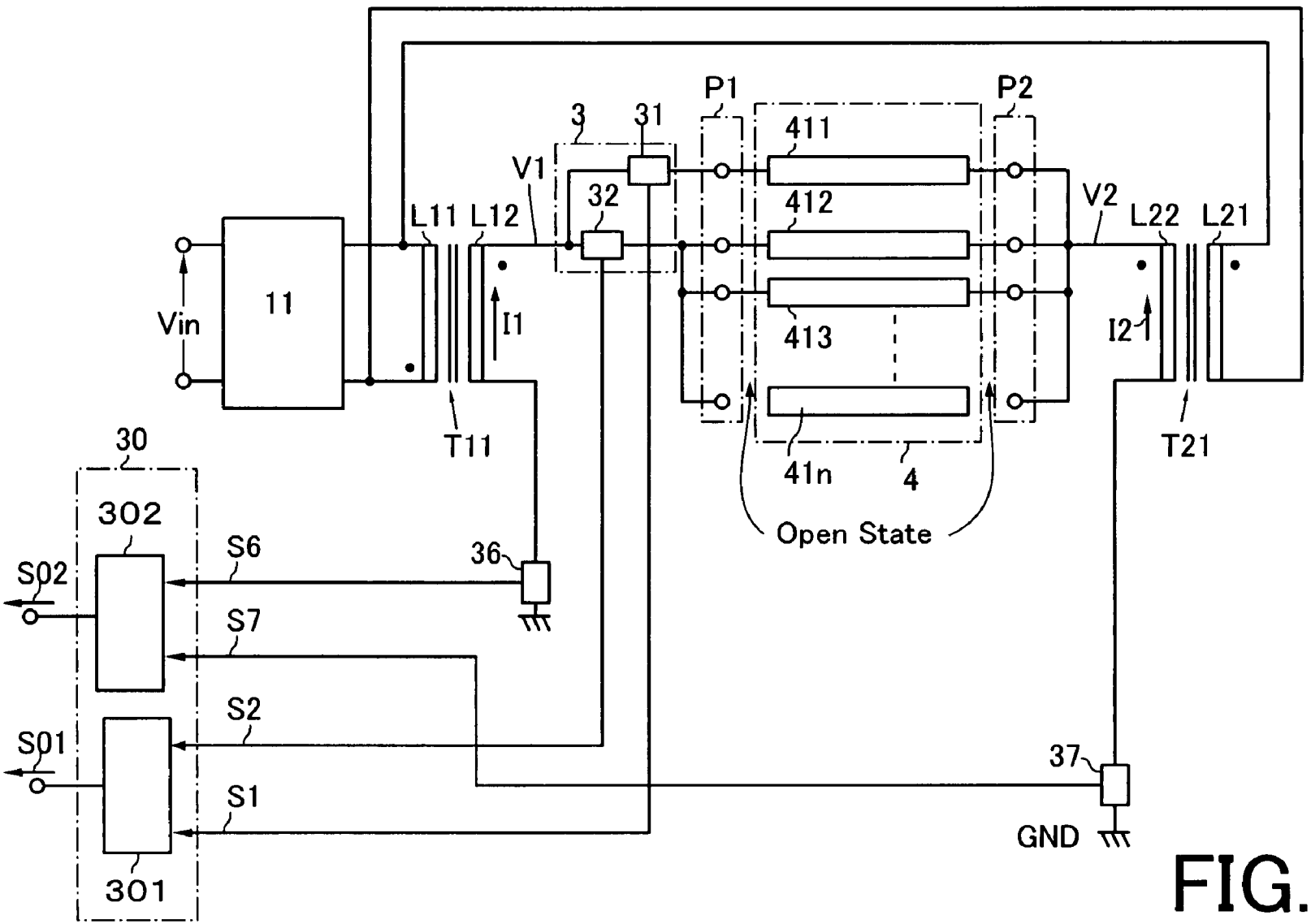
FIG. 3 is a view showing an example where a two-side open state is provided in the discharge lamp lighting apparatus depicted in FIG. 1.

A description will now be given on an example of a two-side open state with reference to FIG. 3. As shown in FIG. 3, when the discharge lamp 41*n* enters the two-side open state, the signal ratio (S1/S2) is changed to 1/(n−2) with a reduction in the number of the discharge lamps through which the current flows from n to (n−1).

Since the signal ratio (S1/S2) is changed from 1/(n−1) to 1/(n−2), the first processing portion 301 can determine the two-side open state. In the present invention, it is preferable for the number of the discharge lamps of which the first current detection circuit 31 have charge to be one.

In the embodiment, the one-side open state of the discharge lamp can be detected by the current detection circuits 36 and 37 and the second processing portion 302. For example, when the discharge lamp 41*n* enters the open state on the first discharge lamp connection terminal group P1 side, a leakage current due to a parasitic capacitance to ground flows from the discharge lamp 41*n* on the second discharge lamp connection terminal group P2 side, and hence the signal S6 detected by the output current detection circuit 36 and the signal S7 detected by the output current detection circuit 37 have different values. The second processing portion 302 detects the one-side open state from a difference between the signal S6 and the signal S7, and outputs the signal S02.

Figure 4:
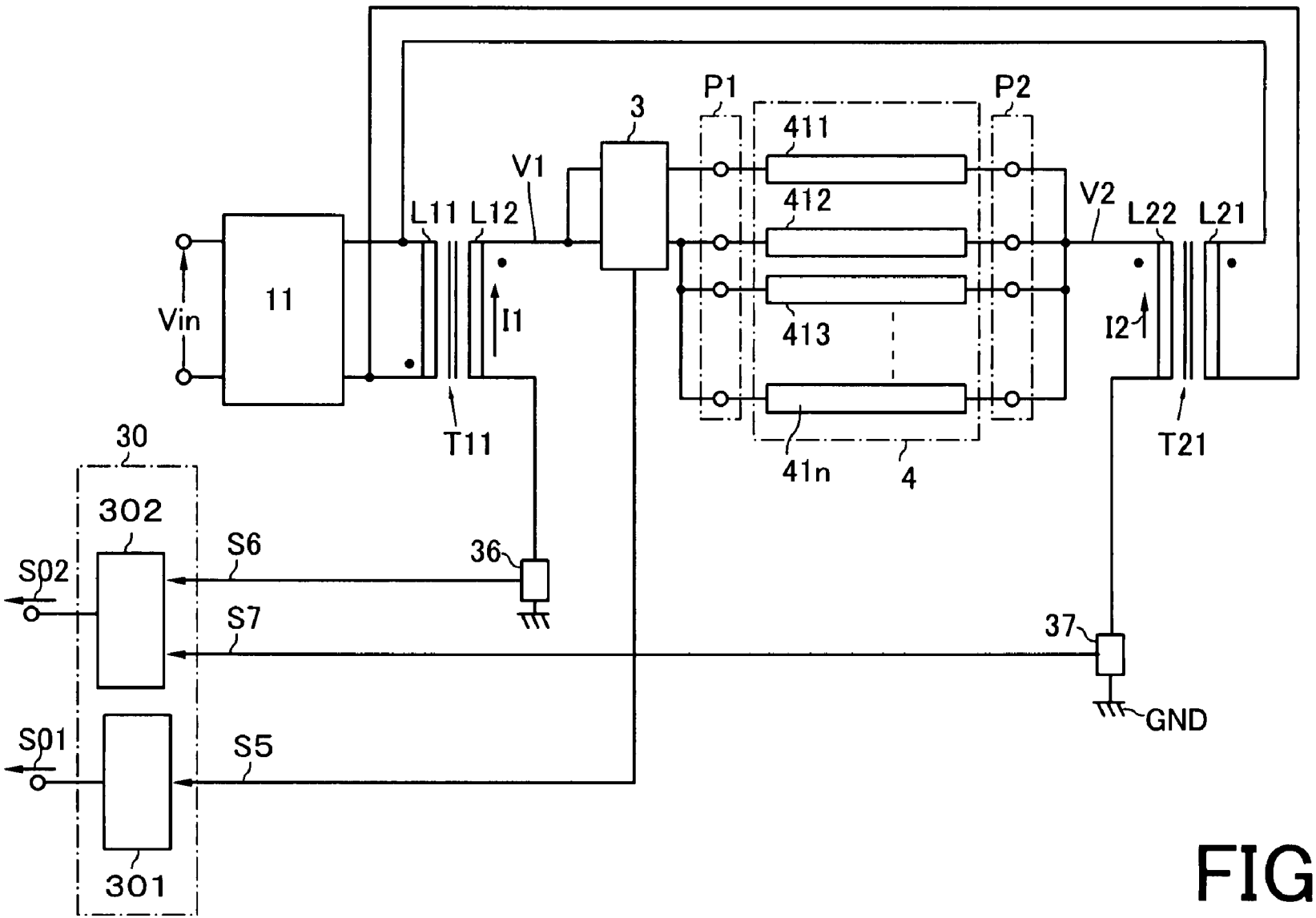
FIG. 4 is an electric circuit diagram showing another embodiment of the discharge lamp lighting apparatus according to the present invention.
Figure 5:
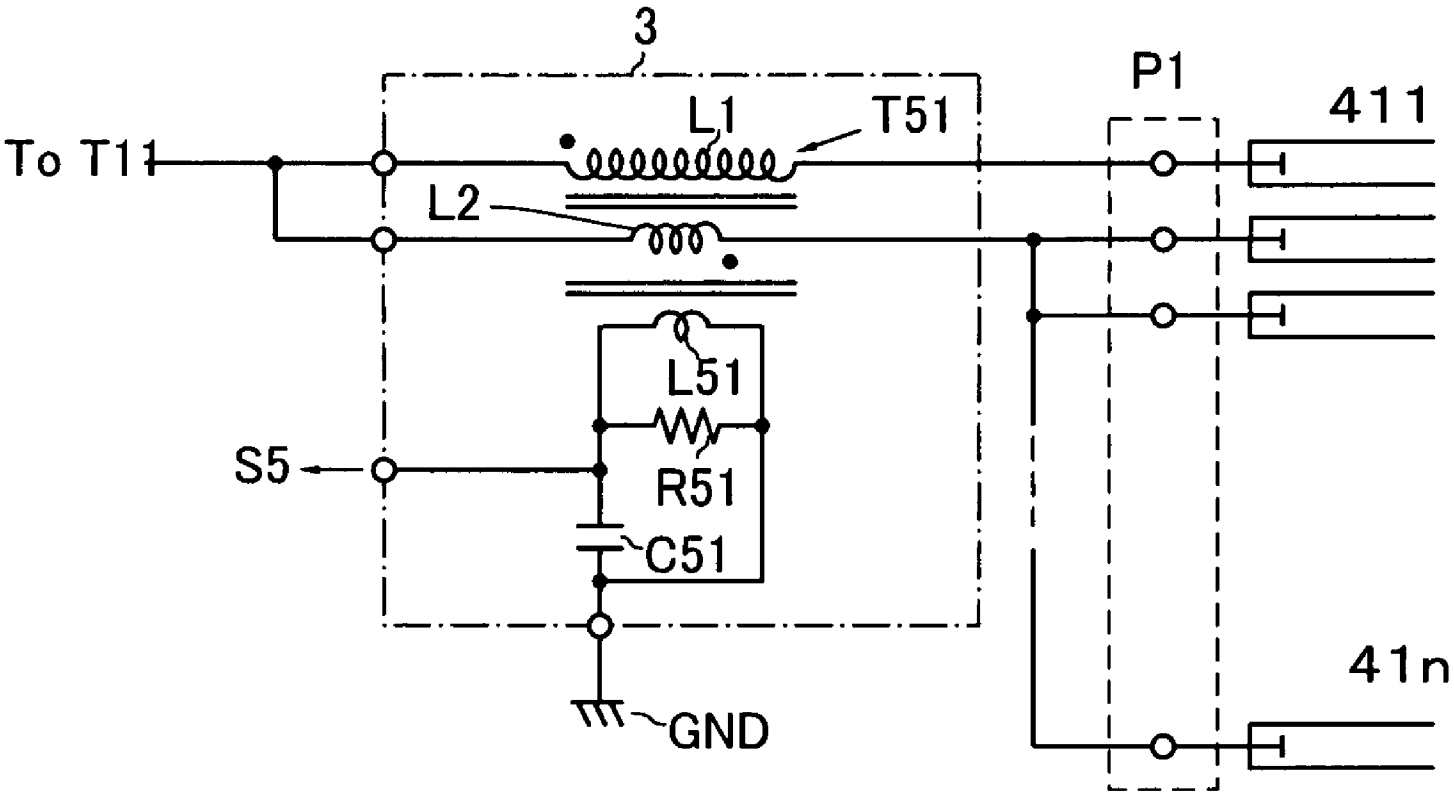
FIG. 5 is a concrete circuit diagram of a current detection circuit used in the discharge lamp lighting apparatus depicted in FIG. 4.

FIG. 4 is an electric circuit diagram showing another embodiment of the discharge lamp lighting apparatus using the discharge lamp drive apparatus according to the present invention, and FIG. 5 is a view showing a concrete circuit configuration of the current detection circuit used in the discharge lamp lighting apparatus depicted in FIG. 4. In the drawings, like reference numerals denote parts equal to the constituent parts shown in FIGS. 1 to 3, thereby eliminating the tautological explanation.

In FIG. 4, a current detection circuit 3 simultaneously detects a current flowing through at least one discharge lamp connection terminal, specifically, a terminal to which a discharge lamp 411 is connected in a first discharge lamp connection terminal group P1 and a sum total of currents flowing through other terminals included in the first discharge lamp connection terminal group P1, specifically, terminals to which discharge lamps 412 to 41*n* are connected, and outputs a signal S5 which is an output obtained by combining the detected results.

Specifically, the current detection circuit 3 is, as shown in FIG. 5, constituted of one transformer T51. The transformer T51 includes a first coil L1, a second coil L2 and a detection coil L51. The first coil L1 detects a current flowing through the discharge lamp 411. The second coil L2 detects a sum total of currents flowing through the discharge lamp connection terminals to which the discharge lamps 412 to 41*n* are connected. The detection coil L51 electromagnetically couples the first coil L1 and the second coil L2, and outputs the signal S5.

Assuming that the number of the discharge lamps 411 to 41*n* is n and the number of the discharge lamps of which the second coil L2 has charge is m, the number of windings of each of the first and second coils L1 and L2 is set to attain the following expression:

$$(\text{The number of windings of the first coil } L1):(\text{the number of windings of the second coil } L2)=n-m:m$$

Additionally, polarities of the first and second coils L1 and L2 are set in which a manner that a magnetic flux obtained by a current flowing through the first coil L1 and a magnetic flux obtained by a current flowing through the second coil L2 are canceled out each other when all the discharge lamps are normally connected.

Therefore, for example, when the discharge lamp 41*n* in the discharge lamps 412 to 41*n* of which the second coil L2 has charge enters the open state, the magnetic flux obtained by the current flowing through the first coil L1 and the magnetic flux obtained by the current flowing through the second coil L2 become unbalanced, and hence a voltage corresponding to a degree of unbalance is induced in the detection coil L51. The detection coil L51 constitutes a detection circuit together with a resistance R51 and a capacitor C51.

In the above-described configuration, when all the discharge lamps 411 to 41*n* are normally connected, the first current detection signal S1 and the second current detection signal S2 are canceled out, and the signal S5 becomes zero. The signal processor 30 determines that the two-side open state is not provided based on the fact that the signal S5 is zero.

On the other hand, for example, when the discharge lamp 41*n* enters the two-side open state, since the magnetic flux obtained by the current flowing through the first coil L1 and the magnetic flux obtained by the current flowing through the second coil L2 become unbalanced, a voltage corresponding to a degree of unbalance is induced in the detection coil L51, thereby generating the signal S5.

The signal processor 30 determines that one of the discharge lamps 412 to 41*n* is in the open state based on the signal S5, and generates the signal S01 which is used to detect the open state.

The one-side open state of the discharge lamp is determined in a second processing portion 302 of the signal processor 30 by supplying the signals S2 and S7 output from a current detection circuit 32 and a current detection circuit 37 to the second processing portion 302.

Figure 6:
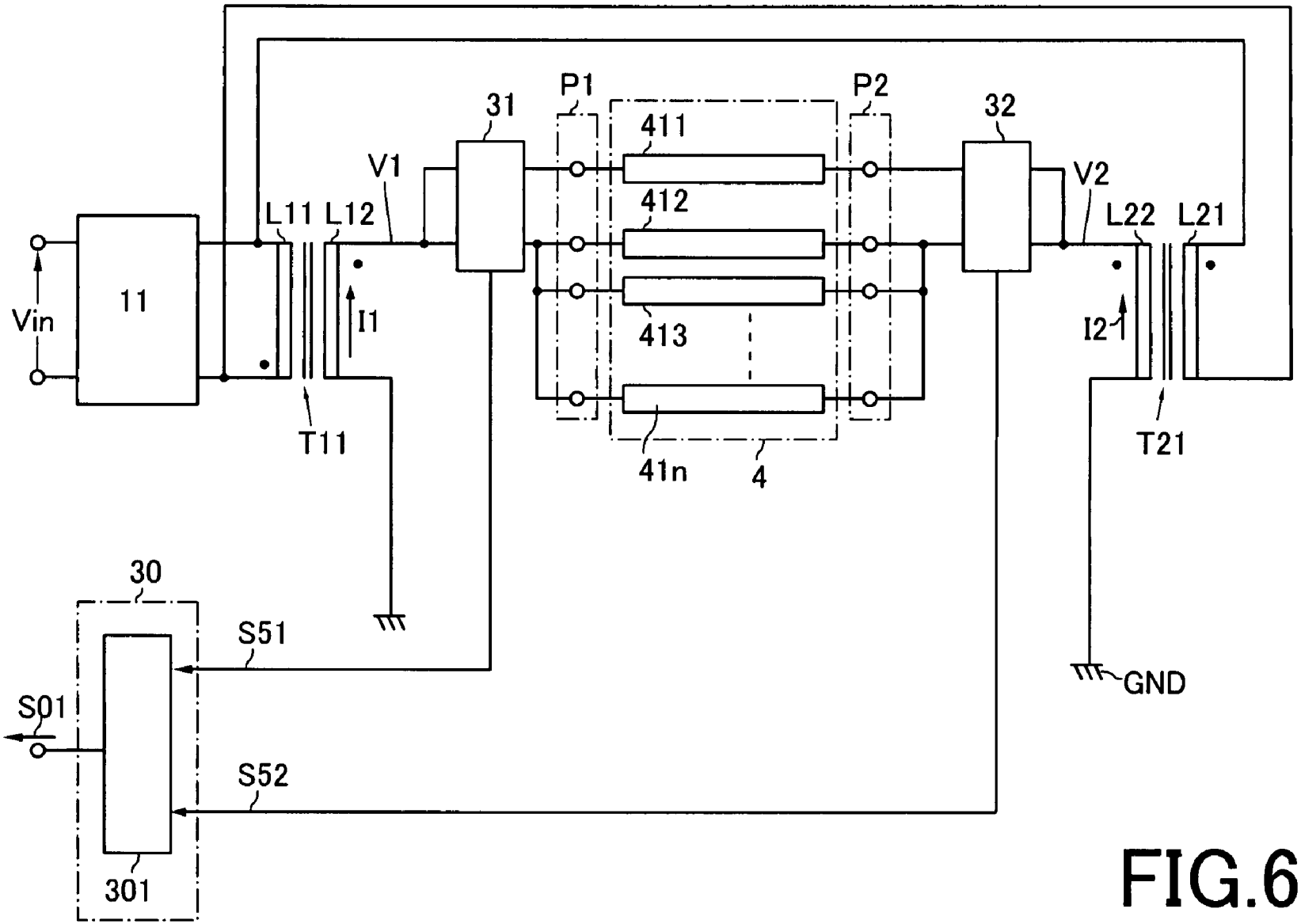
FIG. 6 is an electric circuit diagram showing still another embodiment of the discharge lamp lighting apparatus using the discharge lamp drive apparatus according to the present invention.

FIG. 6 is an electric circuit diagram showing still another embodiment of the discharge lamp lighting apparatus using the discharge lamp drive apparatus according to the present invention. In the drawing, like reference numerals denote parts equal to the constituent parts shown in FIGS. 1 to 5, thereby eliminating the tautological explanation. In this embodiment, a first current detection circuit 31 and a second current detection circuit 32 are respectively provided on a first discharge lamp connection terminal group P1 side and a second discharge lamp connection terminal group P2 side. The first current detection circuit 31 detects a current flowing through a terminal to which one electrode of a discharge lamp 411 is connected and a sum total of currents flowing through connection terminals of discharge lamps 412 to 41*n*, and generates a current detection signal S51 indicative of the detected currents. The second current detection circuit 32 detects a current flowing through a terminal to which the other electrode of the discharge lamp 411 is connected and a sum total of currents flowing through the connection terminals of the discharge lamps 412 to 41*n*, and generates a current detection signal S52 indicative of these detected currents. Each of the first current detection circuit 31 and the second current detection circuit 32 is constituted of the transformer shown in FIG. 5.

A processing portion 301 of a signal processor 30 receives the current detection signals S51 and S52 from the first and second current detection circuits 31 and 32, and generates a signal S01 which is used to detect an open state of a discharge lamp based on the current detection signals S51 and S52.

An advantage of this embodiment lies in that not only the two-side open state but also the one-side open state of a discharge lamp can be detected based on the current detection signals S51 and S52.

Figure 7:
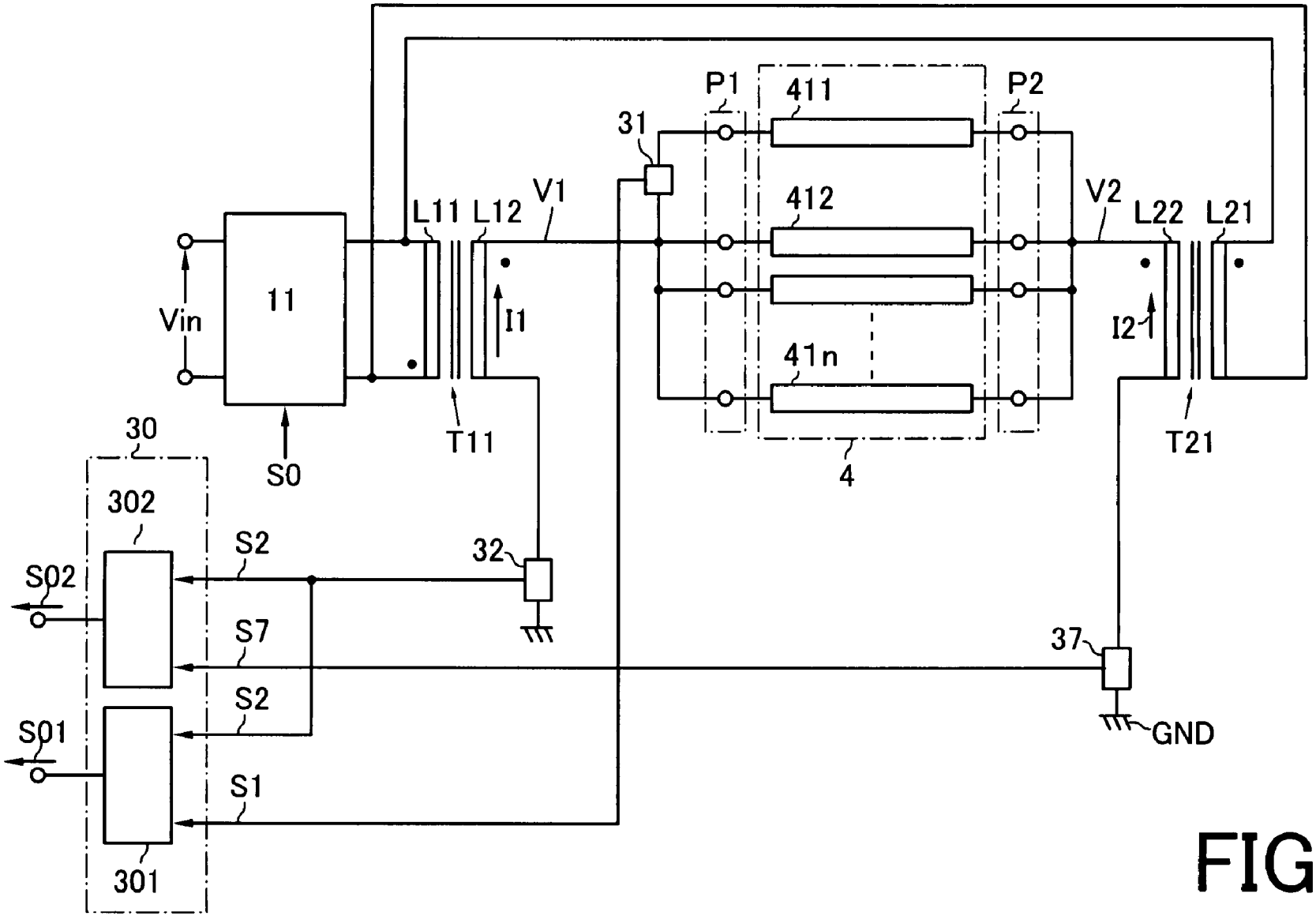
FIG. 7 is an electric circuit diagram showing yet another embodiment of the discharge lamp lighting apparatus using the discharge lamp drive apparatus according to the present invention.

FIG. 7 is an electric circuit diagram showing yet another embodiment of the discharge lamp lighting apparatus using the discharge lamp drive apparatus according to the present invention. In the drawing, like reference numerals denote parts equal to the constituent parts shown in FIGS. 1 to 5, thereby eliminating the tautological explanation.

In FIG. 7, a current detection circuit includes a first current detection circuit 31 and a second current detection circuit 32. The first current detection circuit 31 detects a current flowing through at least one discharge lamp connection terminal selected from a first discharge lamp connection terminal group P1, and generates a first current detection signal S1. The second current detection circuit 32 detects a current flowing through an output winding S12 of a first transformer T1, and generates a second current detection signal S2.

A signal processor 30 receives the first current detection signal S1 and the second current detection signal S2, and generates a signal S01 which is used to detect an open state of a discharge lamp based on intensities of both the current detection signals.

In the illustrated embodiment, since the first current detection signal S1 is a signal corresponding to a current flowing through one discharge lamp 411 and the second current detection signal S2 is a signal corresponding to currents flowing through (n−1) discharge lamps, a signal ratio (S1/S2)=1/(n−1) is achieved when all the discharge lamps 411 to 41*n* are normally connected.

Figure 8:
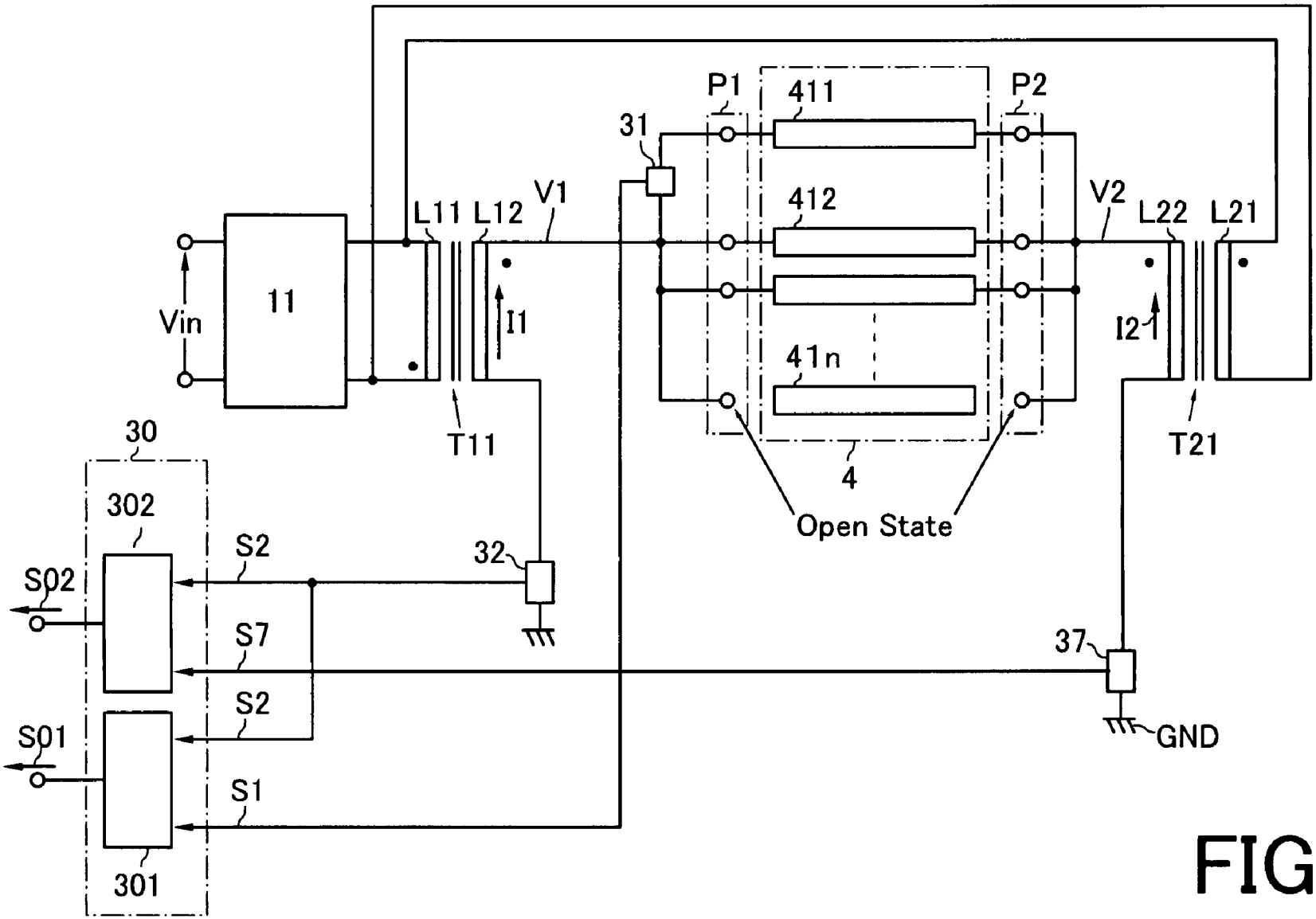
FIG. 8 is a view showing an example where a two-side open state is provided in the discharge lamp lighting apparatus depicted in FIG. 7.

On the other hand, as shown in FIG. 8, when the discharge lamp 41*n* enters a two-side open state, a signal ratio (S1/S2)=1/(n−2) is attained.

A first processing portion 301 of the signal processor 30 determines the two-side open state based on the fact that the signal ratio (S1/S2) has changed from 1/(n−1) to 1/(n−2), and outputs a signal S01.

The one-side open state of the discharge lamp is determined in a second processing portion 302 of the signal processor 30 by supplying signals S2 and S7 output from the current detection circuit 32 and the current detection circuit 37 to the second processing portion 302.

Although the description has been given on the example where the current detection circuit (3, 31, 32) is provided on the first discharge lamp terminal group P1 side in each of the foregoing embodiments, it is self-evident that the same function and effect can be obtained even if the current detection circuit is provided on the second discharge lamp terminal group P2 side or both the first discharge lamp connection terminal group P1 side and the second discharge lamp connection terminal group P2 side.

While the present invention has been particularly shown and described with reference to preferred embodiments thereof, it will be understood by those skilled in the art that various changes in form and detail may be made therein without departing from the spirit, scope and teaching of the invention.

What is claimed is:

1. A discharge lamp drive apparatus comprising: an inverter circuit; first and second transformers; a current detection circuit; and a signal processor, wherein the inverter circuit is a circuit which converts a direct-current voltage into an alternating voltage and outputs the converted voltage, the first transformer receives the alternating voltage from the inverter circuit at an input winding thereof, and supplies a first alternating voltage to a first discharge lamp connection terminal group from an output winding thereof, the first discharge lamp connection terminal group includes a plurality of discharge lamp connection terminals, the plurality of discharge lamp connection terminals being configured to be connected with a plurality of discharge lamps, the second transformer receives the alternating voltage from the inverter circuit at an input winding thereof, and supplies a second alternating voltage to a second discharge lamp connection terminal group from an output winding thereof, the second discharge lamp connection terminal group includes a plurality of terminals corresponding to the first discharge lamp connection terminal group, the plurality of terminals being configured to be connected with a plurality of discharge lamps, the current detection circuit detects a current flowing through at least one discharge lamp connection terminal included in the first or second discharge lamp connection terminal group and a sum total of currents flowing through the other terminals included in the first or second discharge lamp connection terminal group, and the signal processor receives a current detection signal from the current detection circuit, and generates a signal which is used to detect an open state of a discharge lamp from the current detection signal.

2. The discharge lamp drive apparatus according to claim 1, wherein the current detection circuit is constituted of one transformer including three windings.

3. The discharge lamp drive apparatus according to claim 1, wherein the current detection circuit is provided to the first discharge lamp connection terminal group and the second discharge lamp connection terminal group.

4. A discharge lamp drive apparatus comprising: an inverter circuit; first and second transformers; first and second current detection circuit; and a signal processor, wherein the inverter circuit is a circuit which converts a direct-current voltage into an alternating voltage and outputs the converted voltage, the first transformer receives the alternating current from the inverter circuit at an input winding thereof, and supplies a first alternating voltage to a first discharge lamp connection terminal group from an output winding thereof, the first discharge lamp connection terminal group includes a plurality of discharge lamp connection terminals, the plurality of discharge lamp connection terminals being configured to be connected with a plurality of discharge lamps, the second transformer receives the alternating voltage form the inverter circuit at an input winding thereof, and supplies a second alternating voltage to a second discharge lamp connection terminal group from an output winding thereof, the second discharge lamp connection terminal group includes a plurality of discharge lamp connection terminals corresponding to the first discharge lamp connection terminal group, the plurality of discharge lamp connection terminals being configured to be connected with a plurality of discharge lamps, the first current detection circuit detects a current flowing through at least one discharge lamp connection terminal selected from the first or second discharge lamp connection terminal group, and generates a first current detection signal, the second current detection circuit detects a current flowing through the output winding of the first or second transformer, and generates a second current detection signal, and the signal processor receives the first current detection signal and the second current detection signal, and generates a signal which is used to detect an open state of a discharge lamp based on intensities of both the current detection signals.

5. The discharge lamp drive apparatus according to claim 1, wherein the first alternating voltage has a phase difference of 180 degrees with respect to the second alternating voltage.

6. The discharge lamp drive apparatus according to claim 4, wherein the first alternating voltage has a phase difference of 180 degrees with respect to the second alternating voltage.

7. A liquid crystal display apparatus comprising: a discharge lamp drive apparatus; a plurality of discharge lamps; and a liquid crystal plate, wherein the discharge lamp drive apparatus comprises an inverter circuit; first and second transformers; a current detection circuit; and a signal processor, wherein the inverter circuit is a circuit which converts a direct-current voltage into an alternating voltage and outputs the converted voltage, the first transformer receives the alternating voltage from the inverter circuit at an input winding thereof, and supplies a first alternating voltage to a first discharge lamp connection terminal group from an output winding thereof, the first discharge lamp connection terminal group includes a plurality of discharge lamp connection terminals, the plurality of discharge lamp connection terminals being configured to be connected with a plurality of discharge lamps, the second transformer receives the alternating voltage from the inverter circuit at an input winding thereof, and supplies a second alternating voltage to a second discharge lamp connection terminal group from an output winding thereof, the second discharge lamp connection terminal group includes a plurality of terminals corresponding to the first discharge lamp connection terminal group, the plurality of terminals being configured to be connected with a plurality of discharge lamps, the current detection circuit detects a current flowing through at least one discharge lamp connection terminal included in the first or second discharge lamp connection terminal group and a sum total of currents flowing through the other terminals included in the first or second discharge lamp connection terminal group, and the signal processor receives a current detection signal from the current detection circuit, and generates a signal which is used to detect an open state of a discharge lamp from the current detection signal, each of the plurality of discharge lamps has one electrode connected with each discharge lamp connection terminal in the first discharge lamp connection terminal group and the other electrode connected with each discharge lamp connection terminal in the second discharge lamp connection terminal group, and the liquid crystal plate is arranged on a front side of the discharge lamps.

8. The liquid crystal display apparatus according to claim 7, wherein the current detection circuit is constituted of one transformer including three windings.

9. The liquid crystal display apparatus according to claim 7, wherein the current detection circuit is provided to the first discharge lamp connection terminal group and the second discharge lamp connection terminal group.

10. A liquid crystal display apparatus comprising: a discharge lamp drive apparatus; a plurality of discharge lamps; and a liquid crystal plate, wherein the discharge lamp drive apparatus comprises an inverter circuit; first and second transformers; first and second current detection circuit; and a signal processor, wherein the inverter circuit is a circuit which converts a direct-current voltage into an alternating voltage and outputs the converted voltage, the first transformer receives the alternating current from the inverter circuit at an input winding thereof, and supplies a first alternating voltage to a first discharge lamp connection terminal group from an output winding thereof, the first discharge lamp connection terminal group includes a plurality of discharge lamp connection terminals, the plurality of discharge lamp connection terminals being configured to be connected with a plurality of discharge lamps, the second transformer receives the alternating voltage form the inverter circuit at an input winding thereof, and supplies a second alternating voltage to a second discharge lamp connection terminal group from an output winding thereof, the second discharge lamp connection terminal group includes a plurality of discharge lamp connection terminals corresponding to the first discharge lamp connection terminal group, the plurality of discharge lamp connection terminals being configured to be connected with a plurality of discharge lamps, the first current detection circuit detects a current flowing through at least one discharge lamp connection terminal selected from the first or second discharge lamp connection terminal group, and generates a first current detection signal, the second current detection circuit detects a current flowing through the output winding of the first or second transformer, and generates a second current detection signal, and the signal processor receives the first current detection signal and the second current detection signal, and generates a signal which is used to detect an open state of a discharge lamp based on intensities of both the current detection signals, each of the plurality of discharge lamps has one electrode connected with each discharge lamp connection terminal in the first discharge lamp connection terminal group and the other electrode connected with each discharge lamp connection terminal in the second discharge lamp connection terminal group, and the liquid crystal plate is arranged on a front side of the discharge lamps.

11. The liquid crystal display apparatus according to claim 7, wherein the first alternating voltage has a phase difference of 180 degrees with respect to the second alternating voltage.

* * * * *